United States Patent [19]

Murek

[11] 3,942,353

[45] Mar. 9, 1976

[54] HIGH ENERGY RATE COUNTERBLOW FORMING MACHINE

[76] Inventor: Josef K. Murek, 4454 Casitas Ave., San Diego, Calif. 92107

[22] Filed: Aug. 22, 1974

[21] Appl. No.: 499,569

Related U.S. Application Data

[63] Continuation-in-part of Ser. No. 386,871, Aug. 9, 1973, abandoned, which is a continuation of Ser. No. 247,096, April 24, 1972, abandoned.

[52] U.S. Cl. ..... 72/354; 72/407

[51] Int. Cl.[2] ..... B21J 7/28

[58] Field of Search ..... 72/407, 445, 453, 354; 100/256, 264, 270

[56] References Cited

UNITED STATES PATENTS

| | | | |
|---|---|---|---|
| 422,557 | 3/1890 | Wellman | 72/407 |
| 2,532,397 | 12/1950 | Evans et al. | 72/407 |
| 3,404,555 | 10/1968 | Murek | 72/445 |
| 3,488,990 | 1/1970 | Brown | 72/407 |

*Primary Examiner*—Lowell A. Larson
*Attorney, Agent, or Firm*—Boniard I. Brown

[57] ABSTRACT

A high energy rate counterblow forming machine having opposing independently movable coaxial rams movable within pressure chambers containing a compressible working fluid for impelling the rams toward one another at high velocity from retracted cocked positions, through working strokes, into forming impact with work parts held in a bolster located between the rams. Operatively connected to the rams are power activated ram retractor means for retracting the rams to cocked position and thereby compressing the ram working fluid. The rams are held in their cocked positions by latches which are releasable in unison to release the rams for movement in unison through their working strokes to form the work parts without unbalanced impact loads on the machine. One described forming machine is adjustable to accommodate work parts of widely varying sizes.

33 Claims, 19 Drawing Figures

HIGH ENERGY RATE COUNTERBLOW FORMING MACHINE

RELATED APPLICATIONS

This application is a continuation-in-part of application Ser. No. 386,871, filed Aug. 9, 1973, which, in turn, is a continuation of Ser. No. 247,096, filed Apr. 24, 1972, both abandoned.

BACKGROUND OF THE INVENTION

1. Field of the Invention

This invention relates generally to the metal forming art and more particularly to an improved high energy rate counterblow forming machine.

2. Prior Art

A variety of high energy rate forming machines have been devised. Generally speaking, such machines have a pair of relatively massive forming members supported on a frame for relative movement toward and away from one another. Mounted on these members are forming die parts which are movable into work forming relation, wherein the die parts define a die cavity conforming to the desired shape of the finished work product to be formed, by relative movement of the forming members toward one another. In a forming operation, a work part to be formed is placed in one die part, and the forming members are impelled together at extremely high velocity by a highly compressed working fluid to bring the forming die parts into forming relation with very high kinetic energy. The work part is thereby subjected to a high intensity or high energy impact which causes the part to undergo plastic flow into conforming relation with the die cavity.

In some forming machines of this kind, one of the forming members is stationary and the other forming member is a movable forming ram or the like which is impelled toward the stationary member. The resulting impact of the movable member with the stationary member produces extreme impact loads on the machine which limit the maximum impact forming energy which the machines can withstand. Other forming machines employ two movable forming members or rams which are impelled toward one another with substantial equal kinetic energies to form work parts in such a way that the machines are not subjected to any unbalanced impact loads. These latter forming machines are commonly referred to as counterblow forming machines. My prior U.S. Pat. No. 3,404,555 discloses such a counterblow forming machine.

Proper operation of a counterblow forming machine presents two basic problems, namely, compression of the working fluid to the correct high pressure levels to impel the forming members toward one another with equal kinetic energies and simultaneous release of the forming members for movement in unison through their working or forming strokes under the force of the compressed working fluid. One method of compressing the working fluid is that described in my aforementioned patent. According to this method, the forming members move within pressure chambers in which the working fluid is confined at an initial high pressure. The fluid is further compressed to a higher pressure level suitable for work forming by retracting the forming members into their cylinders to cocked positions. The forming members are simultaneously released for high velocity movement in unison through their working strokes. Other high energy rate forming machines are described in U.S. Pat. No. 422,557 and U.S. Pat. No. 3,488,990.

SUMMARY OF THE INVENTION

The present invention provides an improved high energy rate counterblow forming machine which utilizes the same basic working fluid compression technique as the forming machine of my prior patent and embodies novel means for retracting the forming members to cocked position and then releasing the members simultaneously for movement through their working strokes. More specifically, the present forming machine has a pair of coaxial forming rams movable independently of one another in cylinders or pressure chambers containing a compressible working fluid under initial relatively high pressure. The rams are movable away from one another into their pressure chambers to cocked positions and toward one another through working strokes into forming impact with work parts held in a bolster mounted on the machine frame between the rams. Retraction of the rams to cocked position compresses the working fluid to the proper high work forming pressure.

Ram retractor means are provided for retracting the forming rams to their cocked positions, thereby compressing the working fluid in the ram pressure chambers or cylinders. The rams are retained in their cocked positions by latches which are releasable in unison to release the forming rams for propulsion through their working strokes in unison by the compressed working fluid.

In one described embodiment of the invention, the ram retractor means comprises a fluid pressure actuator including a pair of telescoping retractor members which are movable by fluid pressure relative to one another longitudinally along and rotatable in unison about an axis parallel to the common axis of the forming rams. These retractor members carry laterally projecting latch shoulders which are rotatable in unison with the members into and from latching engagement with the rams. The ram retractor means includes means for rotating the retractor members and thereby their ram latching shoulders in unison about and driving the members and their shoulders toward and away from one another along the retractor axis.

In operation of the machine, the ram retractor members are first driven longitudinally toward one another and then rotated to engage their shoulders with the forming rams. Thereafter, the retractor members are driven longitudinally away from one another to retract the rams to cocked position and thereby compress the working fluid in the ram pressure chambers of cylinders. The rams are released simultaneously for travel in unison through their working strokes to form work parts by rotating the retractor members to disengage their shoulders from the rams.

In a second described embodiment of the invention, the ram retractor means comprise separate fluid pressure actuators including plungers which are directly coupled to the forming rams, respectively, for independently retracting the rams to their cocked positions. The rams are latched in their cocked positions by latch members which are releasable in unison to release the rams for propulsion through their working strokes in unison by the compressed working fluid in the ram pressure chambers or cylinders. According to a feature of this embodiment, the latch members are embodied in latch units which are adjustable along a direction line parallel to the common axis of the forming rams to adjust the spacing between the rams in their cocked positions and thereby adopt the forming machine to forming work parts of varying sizes. The bolster of this machine is also adjustable to accommodate the different sized work parts.

The forming rams and bolster carry cooperating die parts which form the work parts upon impact of the rams with the work parts at the end of the ram working strokes. The impact loads exerted on the bolster by the forming rams are equalized to virtually eliminate unbalanced impact loading of the bolster. While the disclosed forming machines of the invention have a bolster for clamping work parts to be formed in fixed position between the forming rams, it is considered to be within the scope of the invention to utilize the ram retraction and releasing means of the invention on a counterblow forming machine wherein work parts are formed by direct impact of the rams, as in the counterblow forming machine of my prior patent.

BRIEF DESCRIPTION OF THE DRAWINGS

FIG. 6 is a side elevation of the modified forming machine;

DESCRIPTION OF THE PREFERRED EMBODIMENT

Figure 1:
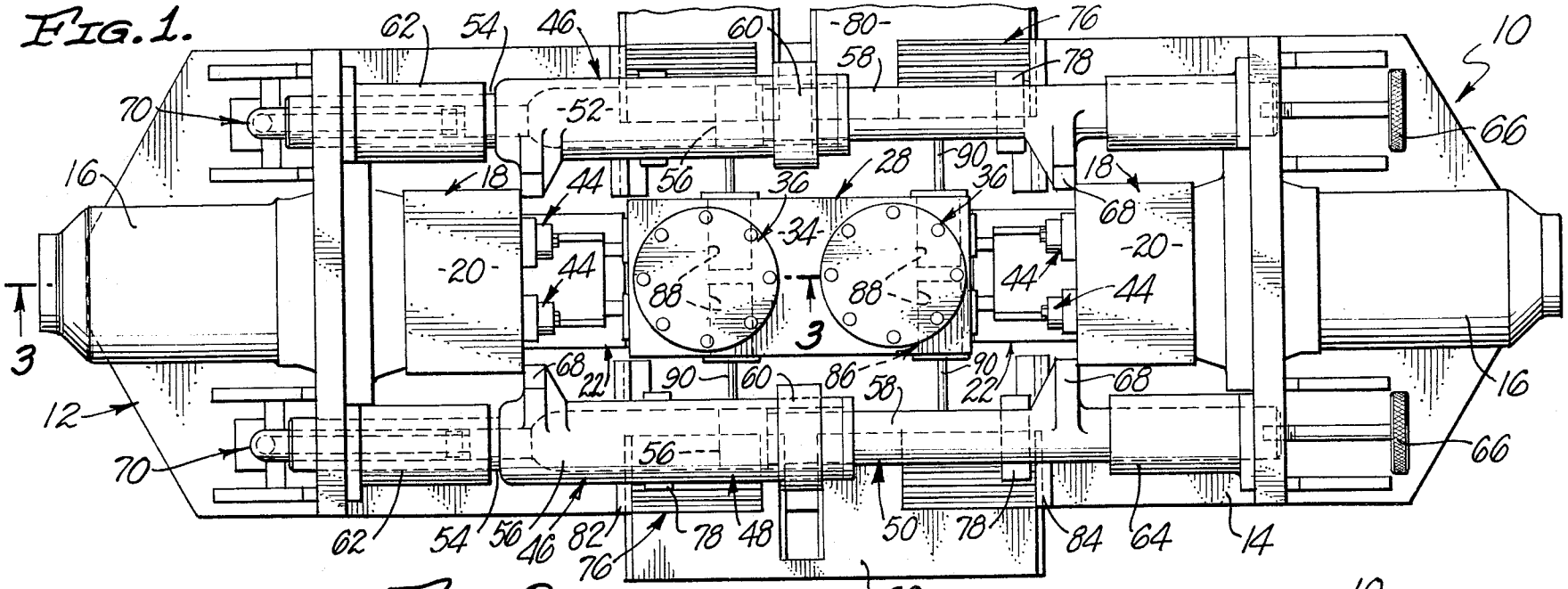
FIG. 1 is a top plan view of a forming machine according to the invention.
Figure 2:
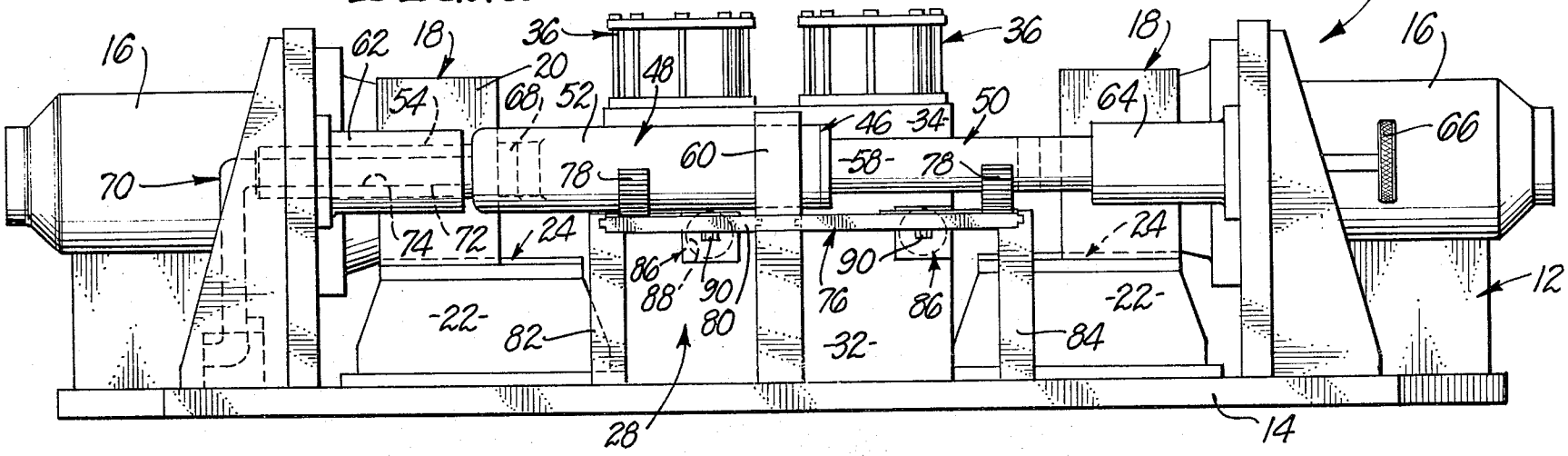
FIG. 2 is a side elevation of the machine.
Figure 3:
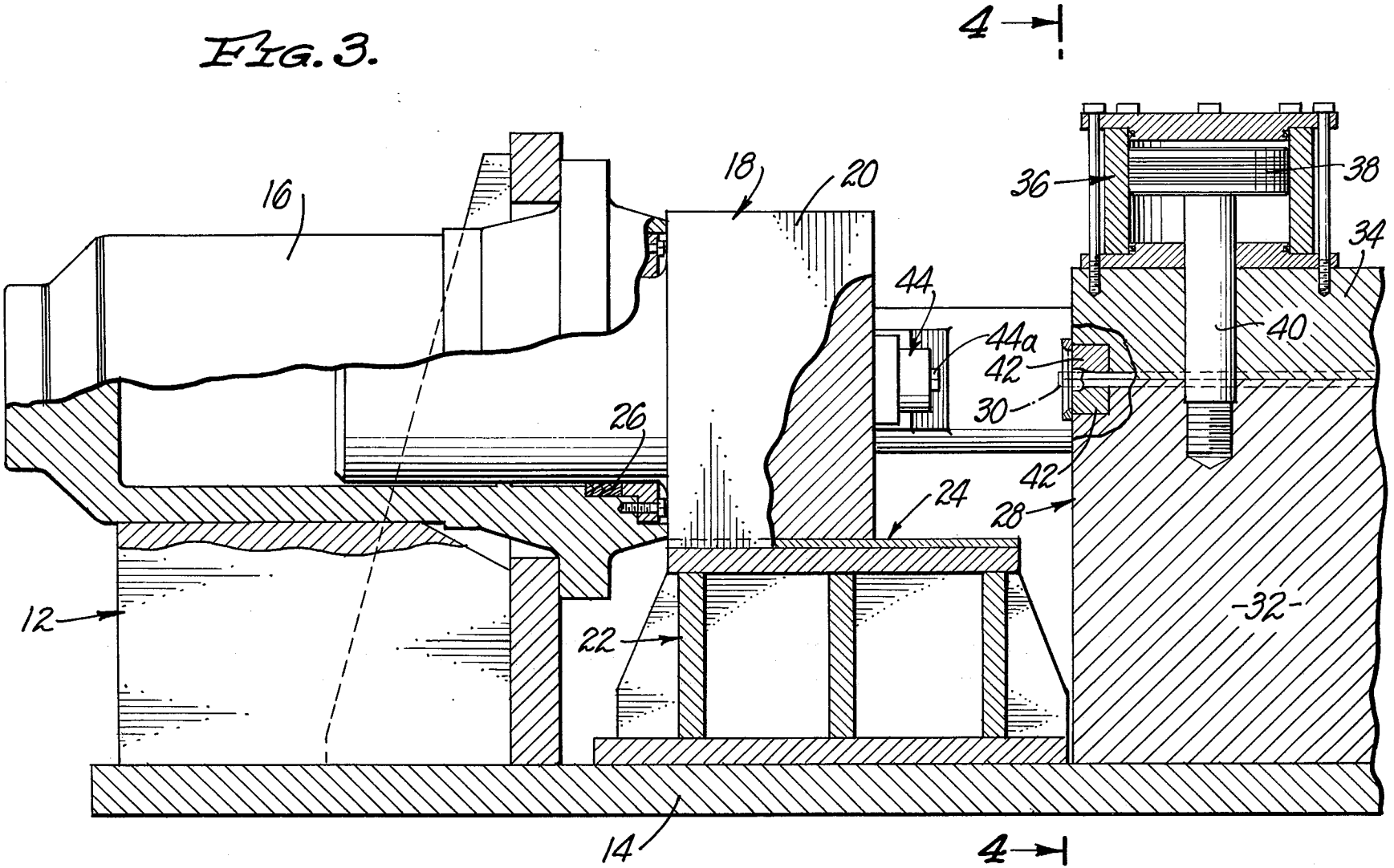
FIG. 3 is an enlarged section taken on line 3—3 in FIG. 1.
Figure 4:
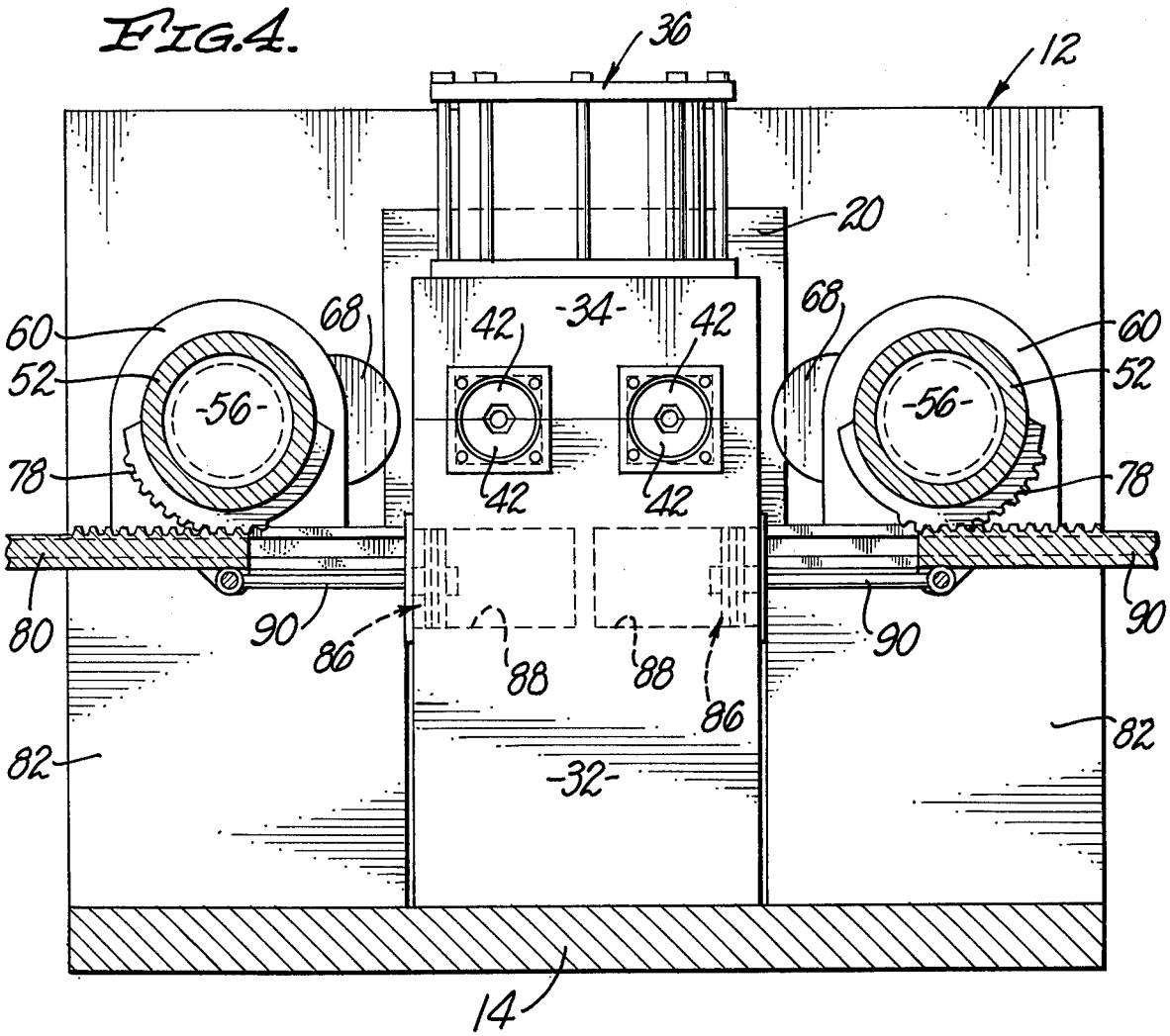
FIG. 4 is a section taken on line 4—4 in FIG. 3.
Figure 5:
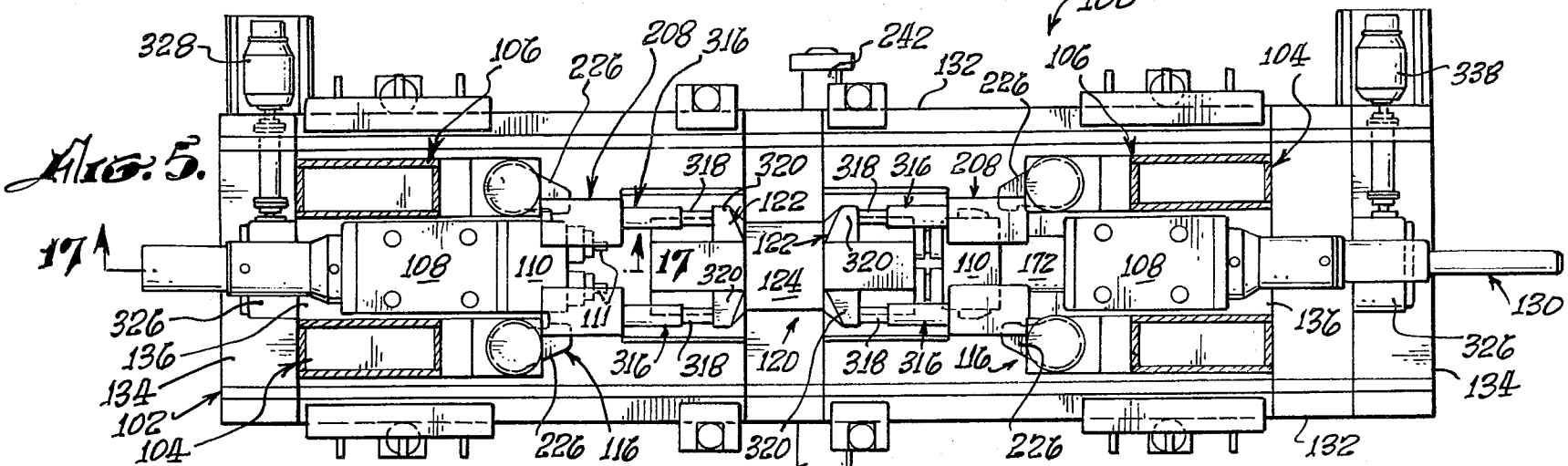
FIG. 5 is a top view with parts broken away of a modified high energy rate forming machine according to the invention which is adjustable to accommodate a range of work part sizes, opposite ends of the machine being shown in two different positions of adjustment and conditions of operation.
Figure 4:
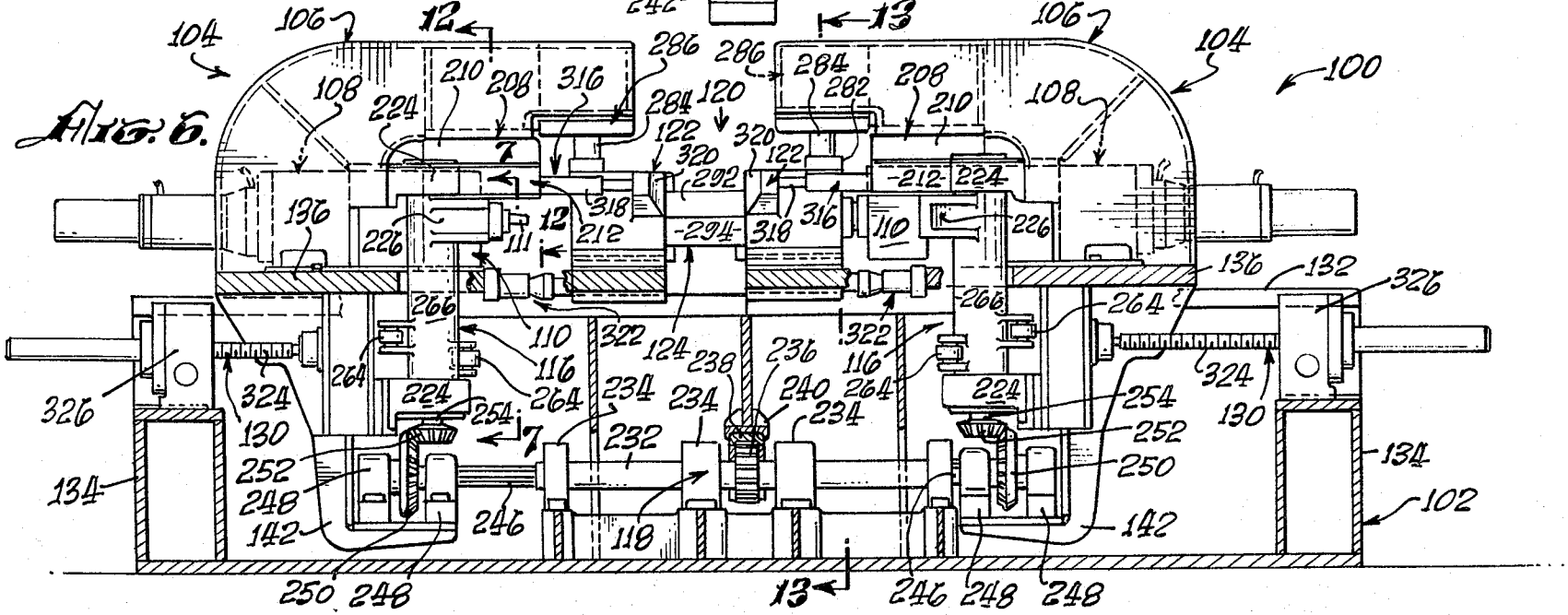

The high energy rate counterblow forming machine 10 of the invention illustrated in FIGS. 1–4 has a frame 12 with a base 14. Mounted at opposite ends of the frame are a pair of forming ram assemblies including coaxial horizontal cylinders or pressure chambers 16 receiving axially movable forming rams 18. Rams 18 project from the adjacent or confronting ends of the pressure chambers and have heads 20 at their outer ends which rest slidably on guide pads 22 rigid on the machine frame 12. Ram heads 20 and guide pads 22 have mating guide ribs and grooves 24 which maintain the rams in precise coaxial alignment. The ram pressure chambers 16 are filled with a compressible working fluid which is normally under relatively high pressure and further compressed by retraction of the forming rams 18 to their cocked positions, shown as mentioned earlier and explained in more detail presently. The forming rams are sealed to their pressure chambers by sealing means 26 to prevent escape of this working fluid.

Between the forming rams 18 is a bolster 28 for holding work parts 30 to be formed. This bolster has a generally block-shaped base 32 rigidly fixed to the frame base 14 and a movable clamping block or plate 34 atop the base 32. Rigidly bolted to the top side of the clamping plate 34 are a pair of clamp cylinders 36. Cylinders 36 contain pistons 38 having rods 40 which pass slidably through openings in the clamping plate and are firmly anchored to the bolster base 32. A hydraulic system (not shown) is provided for feeding hydraulic fluid under pressure to and venting the fluid from the cylinders 36 to raise and lower the clamping plate 34.

The work parts 30 to be formed are firmly clamped between the bolster base 32 and clamp plate 34 during forming operation of the machine by pressurizing the clamping cylinders 36 to urge the clamp plate toward the bolster base. The clamping pressure applied between the plate and base is made sufficient to urge their confronting faces into firm contact so as to prevent the formation of "flash" on the work parts during the forming operation. The particular work parts shown are metal rows with end heads to be formed with axial sockets. The rod heads fit within the cavities of forming die parts 42 carried by the bolster base 32 and clamping plate 34. The forming rams 18 carry mating die parts 44 for forming the sockets. As shown, the illustrated forming machine is designed to simultaneously form sockets in opposite ends of two rods. It will be understood, of course, that the present forming machine may be used for forming shapes other than that discussed above.

Forming rams 18 are movable between their retracted cocked positions shown in the drawings and extended work forming positions wherein the cooperating die parts 42, 44 on the bolster 28 and forming rams are disposed in work forming relation with the socket forming protrusions 44a on the ram die parts 44 projecting into the cavities in the bolster die parts 42. Movement of the rams between cocked and extended positions is referred to herein as their working strokes. The rams are impelled through these working strokes at high velocity by the force of the compressed working fluid in the ram pressure chambers 16. As noted earlier, retraction of the forming rams to cocked position compresses this working fluid to the proper pressure for impelling the rams through their working strokes. The ram masses and pressures are such that the rams produce substantially equal but opposite impact loads on the bolster 28 during each forming operation of the machine. Accordingly, the bolster and machine frame 12 are not subjected to any appreciable unbalanced impact loads.

An important feature of the invention resides in ram retractors 46 for retracting the forming rams 18 to cocked position against the increasing force of the compressing working fluid in the ram pressure chambers 16 and then releasing the rams simultaneously for movement in unison through their working strokes. The ram retractors are essentially identical and each includes a pair of telescoping members 48 and 50 having a common axis parallel to the common axis of the forming rams 18. Member 48 has a cylinder 52 at one end and a coaxial rod or shaft 54 at the opposite end. Member 50 has a plunger 56 at one end slidable in and sealed to the cylinder 52 and a coaxial rod or shaft 58 at the opposite end. The cylinder and shaft of retractor member 48 are slidable in guides 60 and 62, respectively, rigidly fixed to the forming machine base 14. Shaft 58 of retractor member 50 is slidable in a guide 64 rigidly fixed to the machine base. Extending coaxially from the end of the shaft 58 is a rod mounting a knurled handle 66 whose purpose will be explained shortly. Retractor members 48 and 50 have laterally projecting shoulders 68 engagable with and disengagable from the contronting faces of the ram heads 20 by rotation of the members about their common axis.

Means 70 are provided for feeding hydraulic fluid under pressure to the retractor cylinder 52 to force the retractor members 48, 50 apart along their common axis. Means 70 includes a hydraulic fluid supply conduit 72 projecting slidably into and sealed to the wall of a hydraulic fluid passage 74 in the shaft 54 of retractor member 48. Retractor members 48, 50 are rotated in unison about their common axis by fluid pressure actuated rack and pinion means 76. Rack and pinion means 76 comprise pinions, or more exactly pinion segments, 78 about the retractor members and a horizontal rack plate 80 parallel to the retractor axis and meshing with the pinions 78. Rack plate 80 is slidably supported by the cylinder guide 62 and additional guides 82, 84 rigid on the machine base 14 at opposite sides of the cylinder guide. Rack plate 80 is driven edgewise by hydraulic fluid actuators 86 including cylinders 88 within the bolster base 32 and plungers 90 movable in the cylinders 88 and fixed to the rack plate. Means (not shown) are provided for feeding hydraulic fluid under pressure to the cylinders 88 to drive the rack plate 80 in each edgewise direction.

The operation of the counterblow forming machine 10 will now be described, assuming that the forming rams 18 are initially fully extended by the fluid pressure in the ram pressure chambers 16. The ram retractors 48 are first contracted longitudinally by pushing to the left on the retractor handles 66 to push the retractor plungers 56 into their cylinders 52. The retractors are then moved axially to centered positions relative to the rams, wherein the ram shoulders 68 are located between the forming rams, by exerting appropriate axial forces on the handles 66. The rack plate actuator cylinders 88 are then pressurized to move the rack plates 80 edgewise in directions to rotate the retractor members 48, 50 in directions to rotate the retractor shoulders 68 to positions between the forming ram heads 20. Thereafter, the retractor cylinders 52 are pressurized through the hydraulic fluid conduits 72 to expand the ram retractors 46 longitudinally and thereby retract the forming rams 18 to their illustrated cocked position. The work parts 30 are then clamped in forming position in the bolster 28. Finally, the rack plate actuator cylinders 88 are pressurized to drive the rack plates 80 edgewise in directions to rotate the retractor shoulders 68 from engagement with the forming rams 18 to release the rams for movement in unison through their working strokes to form the work parts 30.

The high energy rate counterblow forming machine 100 illustrated in FIGS. 5–19 has an elongate base 102 supporting a pair of forming ram assemblies 104 for adjustment toward and away from one another lengthwise of the base. Each ram assembly 104 has a C-frame 106 slidably mounted on the base 102 for movement lengthwise of the base and carrying a cylinder 108 containing a forming ram 110. Cylinders 108 and forming rams 110 are aligned on a common longitudinal axis of the base 102. Forming rams 110 are movable into their cylinders 108 to the retracted or cocked position of FIG. 17 and from their cylinders to the extended position occupied by the right hand forming ram in FIGS. 1 and 2. On the outer ends of the rams are forming die parts 111.

Cylinders 108 have pressure diameters 112 containing a compressible, high pressure working fluid which is further compressed by retraction of the forming rams 110 to their cocked positions and drives the rams through their working strokes. The ram assemblies 104 include means 114 for retracting the rams 110 to their cocked positions of FIG. 17, thereby compressing the working fluid in the ram cylindner pressure chambers 112 and means 116 for releasably locking the rams in their cocked positions. Operatively coupled to the locking means 116 are actuator means 118 for operating the locking means to lock the rams 110 in their cocked positions and releasing the rams in unison for propulsion of the rams through their working strokes in unison by the compressed working fluid in the ram pressure chambers 112.

Figure 14:
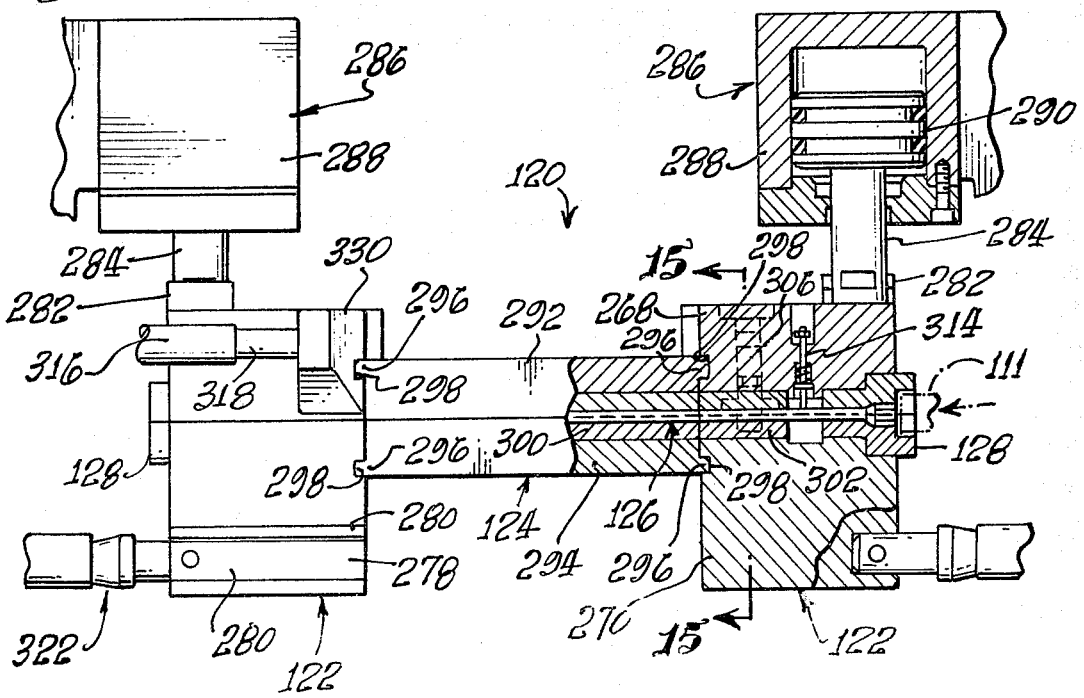
FIG. 14 is an enlarged section taken on line 14—14 in FIG. 13.

Mounted on the machine base 102 midway between its ends is a bolster assembly 120 for holding work parts to be formed. Bolster assembly 120 includes a pair of bolster members 122 supported slidably on the base for adjustment toward and away from one another and a spacer member 124 positioned between the bolster members for maintaining a fixed predetermined spacing between the latter member. This spacer member is removable for replacement by a spacer member of different length to maintain a different spacing between the bolster members. The work parts to be formed, which in this instance are rods 126, are placed, as shown in FIG. 14, in forming position in the bolster assembly 120. In this forming position, the work parts extend through the bolster and spacer members 122, 124 with their ends protruding into forming dies 128 at the outer sides of the bolster members. As explained later, the bolster assembly 120 is constructed to permit placement of the work parts in and removal of the parts from the assembly and to firmly clamp the parts in forming position in the assembly.

Bolster assembly 120 is designed to receive work parts of varying length. Thus, when work parts 126 of greater length than those illustrated are to be formed, the spacer member 124 is removed and replaced by one of appropriately greater width. Similarly, if work parts of shorter length are to be formed, the spacer member is replaced by one of appropriately narrower width.

The forming ram assemblies 104 are also adjustable along the machine base 102 to accommodate the work parts of varying length. More specifically, the ram assemblies are adjusted to positions such that the spacing between the outer ends of the forming rams 110 when in their retracted cocked positions of FIG. 17 and the bolster forming dies 128 is equal to the full length of the ram working strokes. Accordingly, the rams undergo their full working strokes for every size work part. The ram assemblies are thus adjustable along the base 102 by actuator means 130.

Except for adjustment of the forming ram assemblies 104 and bolster assembly 120 to accommodate the particular work parts to be formed, the operation of the counterblow forming machine 100 is essentially identical to the operation of the machine of FIGS. 1–4. Thus, the forming rams 110 are retracted by the ram retracting means 114 to their cocked positions, thereby compressing the working fluid in the rams cylinder pressure chambers 112. The rams are locked in their cocked positions by the ram locking means 116. The forming operation is initiated by operating the ram lock actuator means 118 to release the forming rams 110 in unison for propulsion through their working strokes in unison by the compressed ram working fluid. At the ends of these working strokes, the ram die parts 111 enter into work forming relation with the bolster die parts 128 to form the work parts 126. In the particular application illustrated, the die parts form the ends of the work parts or rods 126 in the same manner as described in connection with the forming machine of FIGS. 1–4.

Referring now in more detail to the particular forming machine illustrated in FIGS. 5–19, the machine base 102 has a frame-like construction including a pair of horizontal size rails 132 supported at their ends on upright base end members 134. The C-frames 106 of the forming ram assemblies 104 are rigidly secured to base plates 136 which overlap and rest slidably on the base side rails 132 to slidably support the frames on the base for movement along the base. Combined guiding and clamping devices 138 are provided for guiding the ram assembly base plates in their sliding movement along the base rails 132 and clamping the plates in fixed positions to the rails.

Each C-frame 106 has an upper arm 140 above the frame base plate 136 and a lower arm 142 below the plate. As shown best in FIG. 2, the arms of each ram assembly frame extend toward the opposite frame such that the concave sides of the frames, as it were, open toward or face inwardly toward the bolster assembly 120. The cylinder 108 of each ram assembly 104 is mounted in fixed position atop the respective frame base plate 136 and extends through the vertical portion of the assembly C-frame 106, as may be best observed in FIGS. 1 and 2.

Figures 17, 18, 19:
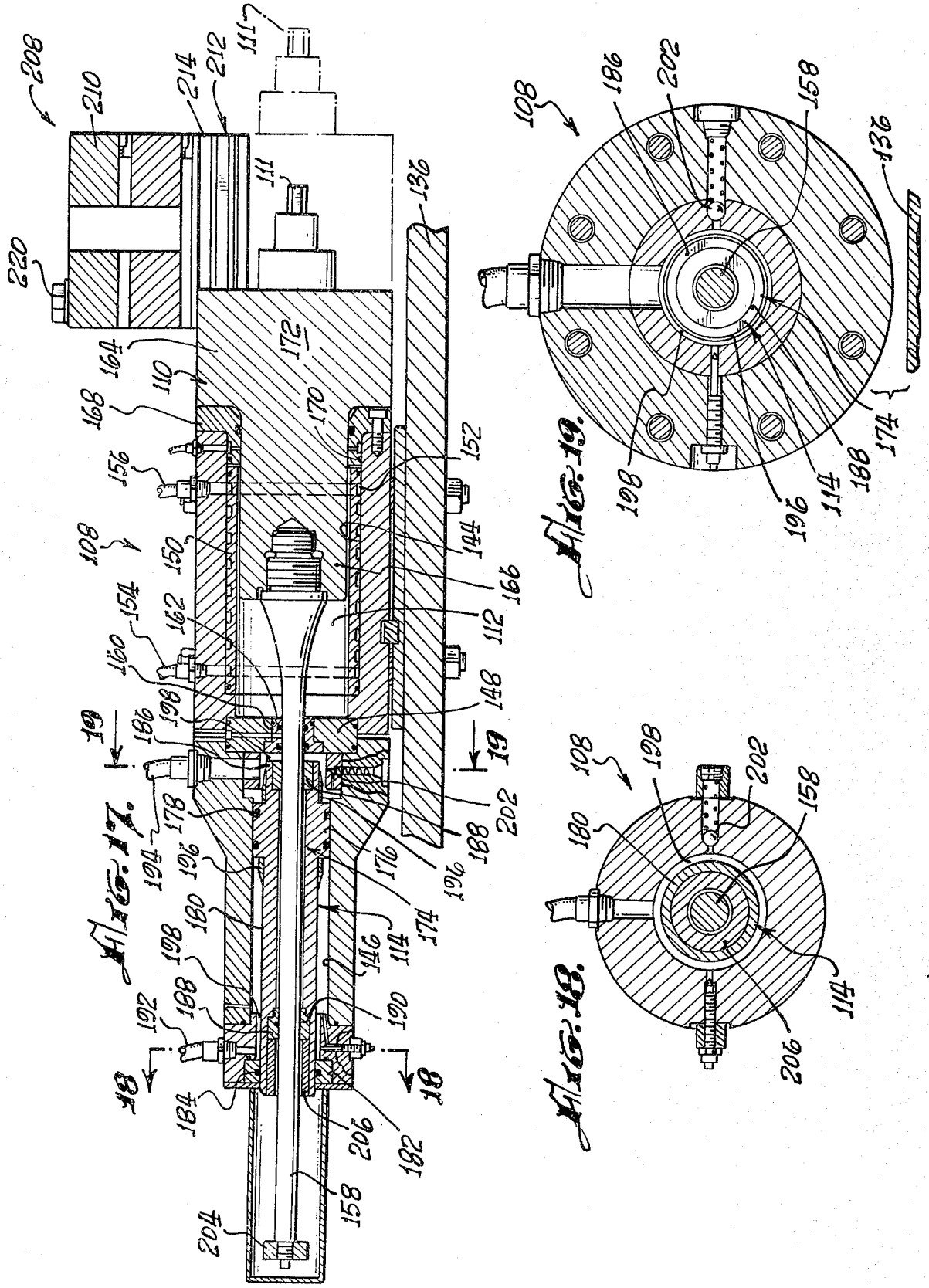
FIG. 17 is an enlarged section taken on line 17—17 in FIG. 5.
FIG. 18 is a section taken on line 18—18 in FIG. 17.
FIG. 19 is a section taken on line 19—19 in FIG. 17.

Turning now to FIG. 17, the ram cylinder 108 and forming ram 110 of a ram assebmly 104 are shown in enlarged section. The ram cylinder has an inner enlarged diameter end containing a relatively large diameter cylinder bore 144 and a smaller diameter outer end containing a relatively small diameter cylinder bore 146. These cylinder bores are coaxially aligned and isolated by an intervening seal plate 148, through which the forming ram 110 extends and to which the ram is sealed, as explained below. Fitted within the large cylinder bore 144 is a liner 150 having a coolant passage 152 extending between a coolant inlet 154 and outlet 156 on the ram cylinder 108.

The forming ram 110 has a relatively slender shaft 158 extending centrally through the cylinder bores 144, 146 and through a slide bearing 160 in the cylinder plate 148. The ram shaft is sealed to the bearing by seal rings 162. Threadedly joined to the inner end of the ram shaft 158, that is, the right-hand end in FIG. 17, is an enlarged ram head 164. This ram head has an inner cylindrical piston end 166 which fits within the cylinder liner 150 with a small clearance between the liner and piston. Bolted to the inner end of the cylinder 108 is an annular slide bearing 168 which surrounds and slidably supports the ram head piston 166. This piston is sealed to the bearing by seal rings 170. Ram head 164 has an outer enlarged rectangular end 172 which mounts the ram die parts 111. As in the forming machine of FIGS. 1–4, these die parts are punches which cooperate with the bolster dies 168 to head and form sockets in the ends of the work parts 126. The cylinder space between the ram cylinder seal plate 148 and the ram piston 166 forms the ram pressure chamber 112 mentioned earlier.

As stated previously, each forming ram assembly includes means 114 for retracting its forming ram 110 to the cocked or retracted position of FIG. 17. Referring to the latter figure, this retracting means comprises an elongate tubular piston 174 which surrounds the ram shaft 158 within the outer ram cylinder bore 146. Piston 174 has an enlarged head 176 adjacent its inner end, i.e., the right-hand end in FIG. 17, which head is slidable in the cylinder bore 146 and is sealed to the wall of the bore by seal ring 178. The outer or left-hand end 180 of the piston has an elongate tubular configuration of reduced diameter relative to the piston head 176 and extends slidably through a bearing 182 in the outer or left-hand end of the cylinder 108 and is sealed to the bearing by seal ring 184. The piston has a short tubular end portion 186 at the inner or right-hand side of the piston head 176. Piston 174 is slidably supported on the ram shaft 158 by bearings 188 and is sealed to the shaft by seal ring 190.

Connected to the ram cylinder 108 are pressure fluid lines 192, 194 for admitting fluid under pressure to and venting fluid from the cylinder bore 146 at opposite sides of the piston head 176 to drive the piston 174 back and forth in the bore. Surrounding the piston ends 180, 186 adjacent the piston head 176 are tapered buffer sleeves 196 which enter cylindrical buffer chambers 198 at the ends of the cylinder 146 as the piston approaches the ends of its strokes. These chambers are vented through spring loaded check or relief valves 202. The buffer sleeves have a close sliding fit in the buffer chambers and cooperate with the chambers and their relief valves to arrest the piston at the ends of its strokes.

Fixed to the outer end of the ram shaft 158 is a collar 204. Fixed within the outer end of the retractor piston 174 is a hardened sleeve 206. As explained in more detail later, the forming ram 110 is retracted to its cocked position by pressurizing the right end of the retractor cylinder bore 146 to drive or extend the retractor piston to the left in FIG. 17. During this left-hand extension of the piston, its sleeve 206 engages the ram collar 204 to draw the forming ram to the left to its retracted position against the force of the pressure fluid in the ram pressure chamber 112. The retractor piston is then returned to its retracted position of FIG. 17 to free the forming ram 110 for propulsion through its working stroke.

Figure 12:
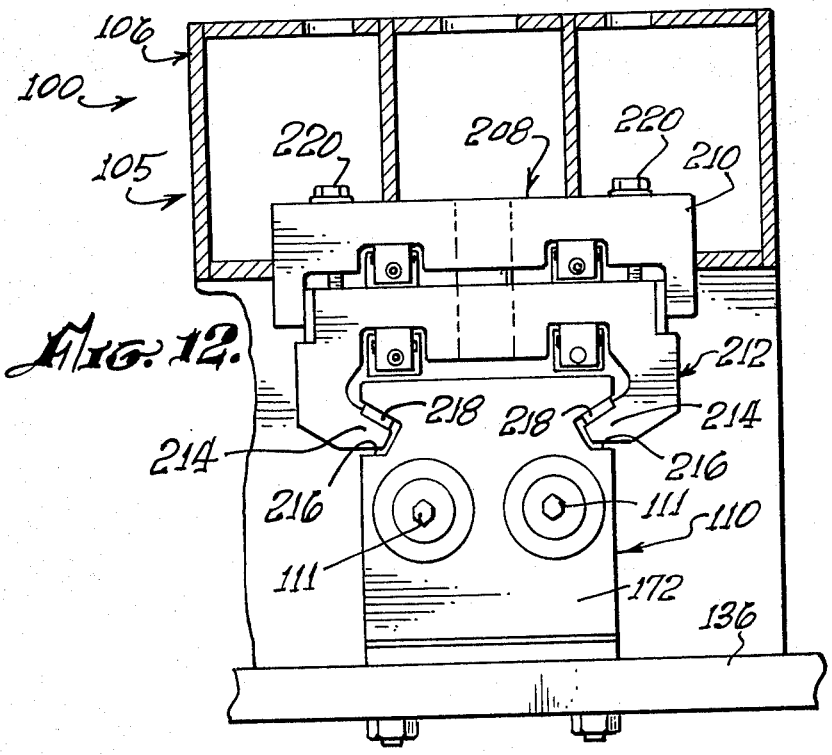
FIG. 12 is an enlarged section taken on line 12—12 in FIG. 6.
Figure 13:
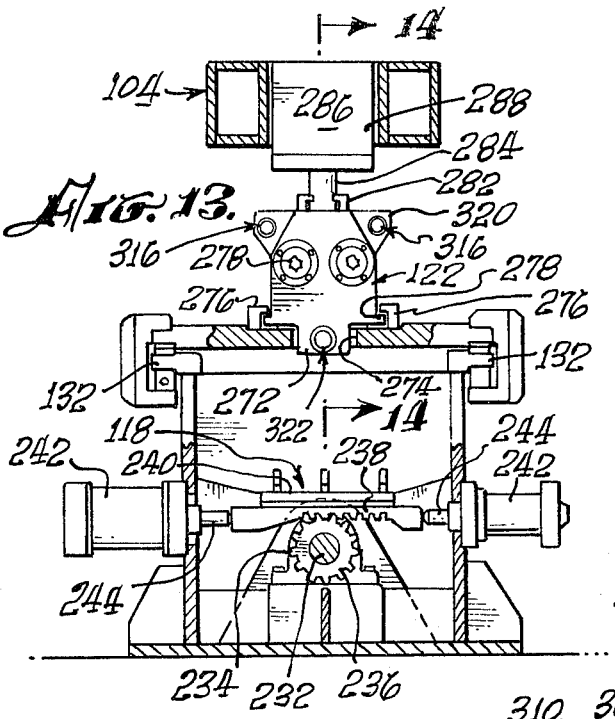
FIG. 13 is an enlarged section taken on line 13—13 in FIG. 6.

Referring particularly to FIGS. 12 and 17, each forming ram assembly 104 includes means 208 for guiding and supporting its forming ram 110 in its working and retraction strokes. Guiding and supporting means 208 comprises a mounting bracket 210 supported on the underside of the upper arm 140 of the respective C-frame 106 over the outer end 164 of the forming ram 110. At the underside of the mounting bracket is a ram guide 212 having arms 214 which straddle and engage within longitudinal channels 216 in the side faces of the ram end 164. The upper faces of these channels are inclined, as shown in FIG. 12, and form bearing faces which rest on bearing pads 218 fixed to the ram guide arms 214. The ram guide 212 is secured to the mounting bracket 210 by bolts 220 which are adjustable to vertically adjust the guide to a position where the forming ram 110 is accurately aligned with its cylinder.

As mentioned earlier, each ram assembly 104 includes means 116 for locking its forming ram 110 in cocked position. Referring particularly to FIGS. 5–11, the locking means 106 of each ram assembly comprises a pair of vertical locking shafts 222 at opposite sides of the ram, in line with its outer end 164 when the ram is retracted to its cocked position. Each locking shaft extends through ram assembly base plate 136 and is rotatably supported at its upper and lower ends by bearings 224 rigid on the assembly C-frame 106. On the upper end of each shaft is a radial arm 226 having a locking shoulder 228 engageable with a locking shoulder 230 on the forming ram 110.

Figure 8:
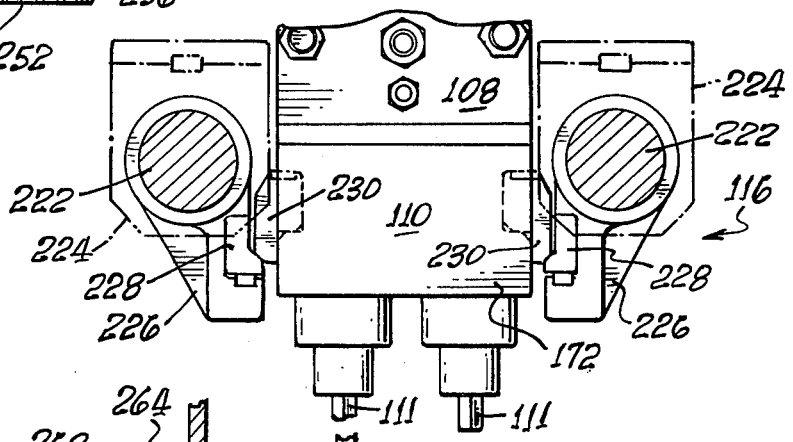
FIG. 8 is a section taken on line 8—8 in FIG. 7.
Figure 10:
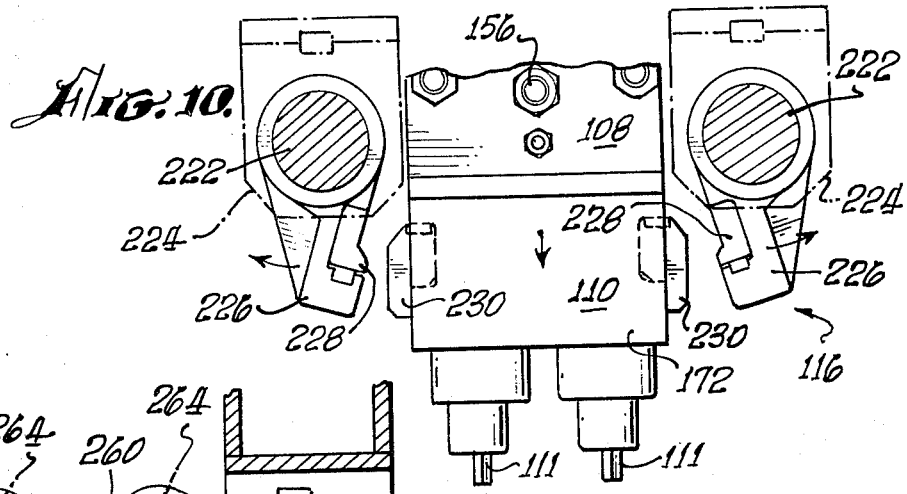
FIG. 10 is a section similar to FIG. 8 with the parts in another position of operation.

Locking shafts 222 are rotatable between their ram locking positions of FIG. 8 and their ram releasing positions of FIG. 10. In the locking positions of the shafts, the shaft locking shoulders 228 engage the ram locking shoulders 230 in the manner shown in FIG. 8 to lock the forming ram 110 in its cocked position. Rotation of the locking shafts in the directions of the arrows in FIG. 8 to their released positions of the latter figure disengages the locking shoulders 228, 230 to release the forming ram 110 for propulsion through its working stroke by the pressurized working fluid in the ram pressure chamber 112.

From the earlier description, it will be recalled that the ram locking means 116 are operated by actuator means 118 which release the locking means of the two ram assemblies 104 in unison. Turning to FIG. 6, actuator means 116 comprises a shaft 232 rotatably supported in bearings 234 on the machine base 102 with the shaft axis extending parallel to the direction line of adjustment of the forming ram assemblies 104 along the base. Fixed on the shaft 232 is a pinion 236. A rack 238 (FIG. 13) meshes with the pinion and is slidably supported by a guide 240 on the machine base 102 for endwise movement to rotate the pinion and thereby the shaft 232. Mounted on the base 102 at opposite ends of the rack 238 are a pair of fluid pressure actuators 242 having plungers 244 engaging the rack ends. From this description, it will be understood that the rack 238 is movable endwise in either direction by the actuators 242 to drive the shaft 232 in the corresponding direction of rotation.

Returning to FIG. 6, each end of the shaft 232 has a splined opening slidably receiving a splined shaft 246. The outer ends of the splined shafts are rotatably supported in bearings 248 fixed on the lower arms 142 of the ram assembly C-frames 106. Fixed on each splined shaft 246 between its bearings 248 is a bevel gear 250 which meshes with a bevel gear 252 rigid on the lower end of a cam shaft 254 (FIG. 7) between the lower ends of and parallel to the ram locking shafts 222 of the corresponding ram assembly 104. Cam shaft 254 is rotatably supported at its ends in bearings 256, 258 on the assembly C-frame 106 and base plate 136. From this description, it is evident that rotation of the pinion shaft 232 by the pinion rack actuators 242 rotates the cam shafts 254 in unison. The slidable splined engagement of the pinion shaft 232 and splined shafts 246 permits adjustment of the forming ram assemblies along the machine base 102.

Figure 7:
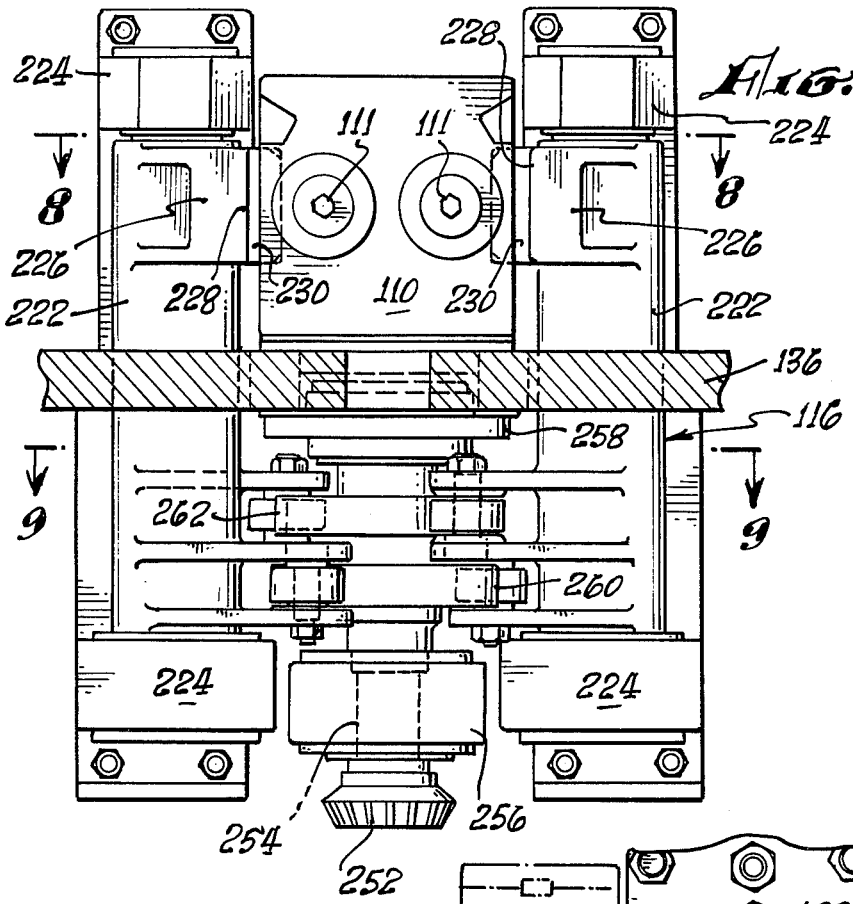
FIG. 7 is an enlarged section taken on line 7—7 in FIG. 5.
Figure 9:
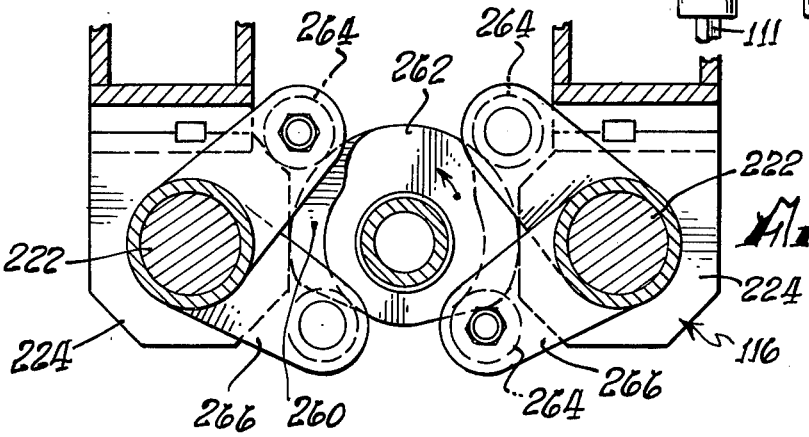
FIG. 9 is a section taken on line 9—9 in FIG. 7.
Figure 11:
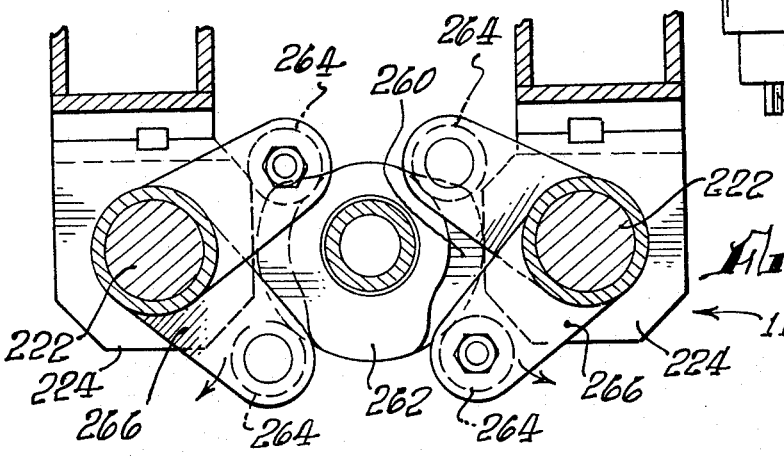
FIG. 11 is a section similar to FIG. 9 with the parts in another position of operation.

As shown best in FIGS. 7, 9 and 11, each cam shaft 254 mounts a pair of plate cams 260, 262 one above the other. These cams are engaged by cam follower rollers 264 rotatably supported on radial arms 266 rigid on the lower ends of the corresponding forming ram locking shafts 222. Cams 260, 262 are shaped and engaged by the followers 264 in the manner shown in FIG. 9 such that rotation of the cam shaft 254 in one direction rotates the ram locking shafts 222 from their ram locking positions to their ram releasing positions. Rotation of the cam shaft on the opposite direction rotates the locking shafts from their ram releasing positions to their ram locking positions. The cams and followers of the two forming ram assemblies 104 are arranged in a manner such that rotation of the pinion shaft 232 in one direction by one pinion rack actuator 242 rotates the ram locking shafts 222 of the two ram assemblies in unison to their ram locking positions. Rotation of the pinion shaft in the opposite direction by the other rack actuator rotates the locking shafts in unison to their ram releasing positions.

From the description to this point, it will be understood that the two forming rams 110 may be retracted by the ram retracting means 114 to their cocked positions to compress the working fluid in their pressure chambers 112 and locked in these cocked positions by the ram locking means 116. The rams are releasable in unison by operation of the ram locking shaft actuator means 118 for propulsion of the rams through their working strokes by the compressed working fluid to form the work parts 126 held in the bolster assembly 120.

Figure 15:
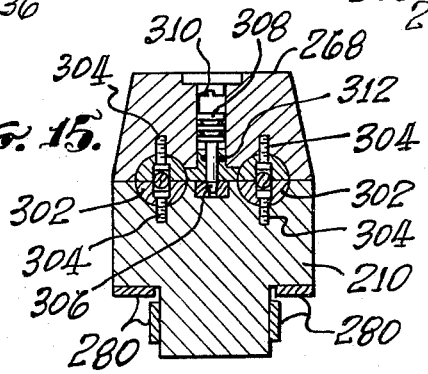
FIG. 15 is a section taken on line 15—15 in FIG. 14.

As noted earlier, the bolster assembly 120 comprises a pair of bolster members 122 and an intervening spacer member 124. Referring particularly to FIGS. 13–16, each bolster member 122 comprises separable upper and lower parts 268, 270. The lower bolster part 270 seats slidably on the base plate 136 of the adjacent forming ram assembly 104 for adjustment lengthwise of the machine, parallel to the direction line of adjustment of the ram assemblies. On the underside of the lower bolster part is a depending formation 272 which projects through an elongated slot 274 in the base plate 136. The lower part is secured to the base plate by guides 276 which overlap flanges 278 on the part. As shown in FIG. 15, the lower bolster part has bearing pads 280 for sliding contact with the upper surface of the base plate and the edges of the base plate slot.

Figure 16:
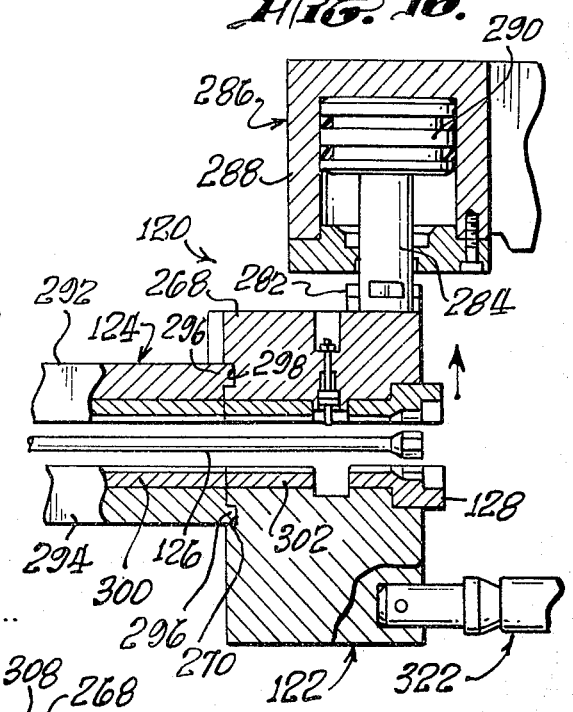
FIG. 16 is a fragmentary section similar to FIG. 14 with the parts in another position of operation.

The upper part 268 of each bolster member 122 has upper guides 282 which engage in slots in opposite sides of the plunger rod 284 of a fluid pressure clamping actuator 286. This actuator has a cylinder 288 rigidly mounted on the upper arm 140 of the adjacent forming ram assembly C-frame 106 and slidably receiving a piston head 290 on the upper end of the plunger rod 284. Means (not shown) are provided for pressurizing and venting the ends of the actuator cylinder 288 to drive the plunger rod 284 up and down. The guides 282 connect the upper bolster part 268 to the rod for vertical movement of the part with the rod, while permitting adjustment of the part with the lower part 270 lengthwise of the machine. From this description, it will be understood that the bolster members 122 are adjustable along the machine parallel to the direction of adjustment of the forming ram assemblies 104 and that the clamping actuators 286 are operable to elevate the upper bolster parts 268 as shown in FIG. 16 and to clamp the upper parts firmly against the lower bolster parts 270, as shown in FIG. 14.

The bolster spacer member 124 comprises a rectangular block-like member which seats against the confronting faces of the bolster members 122. The spacer member is split into upper and lower parts 292, 294 along a parting plane flush with the upper faces of the lower bolster parts 270. Each spacer part 292, 294 has ribs 296 along its edges adjacent the bolster members which engage in grooves 298 in the corresponding bolster parts, whereby the upper spacer part 292 moves vertically with the upper bolster parts 268 when the latter are raised and lowered by their clamping actuators 286.

As noted earlier, the work parts or rods 126 to be formed extend through the bolster members 122 and the spacer member 124. The bolster members and spacer member contain hardened sleeves 300, 302 which receive the rods with a close fit. The ends of the rod project into the forming dies 128 on the bolster members, as mentioned earlier and shown in FIGS. 14 and 16. Sleeves 300, 302 and forming dies 128 are split along the same parting plane as the bolster members and spacer member, such that the upper and lower halves of the sleeves and dies separate when the upper bolster parts 268 and spacer part 292 are elevated by the clamping actuators 286, as in FIG. 16. The upper and lower sleeve and die halves are secured to their respective bolster and spacer parts in any convenient way, as by bolts 304 in the manner shown in FIG. 15.

As shown in this latter figure, each upper bolster part 268 carries a locating pin 306 for locating the upper part relative to the lower bolster part 270. Locating pin 306 is fixed to a piston 308 which slides in a cylinder 310. The pin extends slidably through a bearing 312 on the lower end of the cylinder 310 and, when extended to its position of FIG. 15, projects into a socket 312 in the lower bolster part 270. Means (not shown) are provided for pressurizing and venting the ends, of the locater cylinder 310 to extend the locating pin 306 to its extended locating position of FIG. 15, wherein the pin retains the upper and lower bolster parts 268, 270 in alignment, and retract the pin upwardly from the lower bolster part socket 312. Each upper bolster part 268 also carries a spring loaded work part ejector pin 314.

As mentioned in the earlier description, the forming ram assemblies 104 and the bolster assembly 120 are adjustable to accommodate work parts or rods of different lengths. Adjustment of the bolster assembly for this purpose is accomplished by sliding the bolster members 122 toward or away from one another, as the case may be, and placing between the members a spacer member of appropriate width. Fluid pressure actuators 316 are carried by the ram guides 212 for adjusting the bolster members. These actuators have plungers 318 which are slidably connected to wings 320 on the upper bolster parts 268 in a manner such that the upper parts are movable endwise of the machine by the actuators 316 but are free to move vertically relative to the latter actuators when raised and lowered by the clamping actuators 286. Adjustable spacers 322 are provided between the ram assembly base plates 102 and the lower projecting formations 242 on the lower bolster parts 270 for firmly retaining the bolster members 122 in their adjusted positions.

As mentioned previously, the forming ram assemblies 104 are adjustable by the actuating means 130. These actuating means comprise lead screws 324 rotatably supported in housings 326 mounted on the ends of the machine base 102 below the ram assembly base plates 136. Within the housings 326 are nuts (not shown) which are threaded on the lead screws 324 and driven in rotation to move the lead screws axially by reversible motors 328 through right angle gear drives in the housings. The inner ends of the lead screws 324 are rotatably connected to the ram assembly C-frames 106, whereby axial movement of the screws moves the ram assemblies 104 along the machine base 102 toward or away from one another, depending upon the direction of lead screw rotation.

The operation of the forming machine 100 will now be described. The machine is conditioned for operation by adjusting the bolster assembly 120 to accommodate the length of the particular work parts or rods 126 to be formed. The bolster clamping actuators 286 are then operated to elevate the upper bolster parts 268 and the upper spacer part 292 and the work parts are placed in the bolster assembly. The upper bolster parts and upper spacer part are then lowered to clamp the work parts firmly between the upper parts and the lower bolster and spacer parts 270, 294. The forming ram assembly adjustment actuators 130 are operated to adjust the forming ram assemblies 104 to their proper positions relative to the bolster assembly 120, wherein the spacing between the inner or leading ends of the forming rams 110 and the adjacent bolster members 122 equals the working stroke length of the rams.

After thus setting up the machine, the ram retracting means 114 are operated to retract the forming rams 110 to their cocked positions and the ram locking means 116 are operated by their actuating means 118 to lock the rams in their cocked positions. The machine is now in readiness for its forming operation. This forming operation is initiated by again operating the lock actuating means 118 to release the forming rams 110 for propulsion through their working strokes by the high pressure working fluid in their pressure chambers 112. At the end of these strokes, the ram punches 111 enter the bolster dies 128 to form the ends of the work parts 126.

I claim:

1. A high energy rate impact forming machine, comprising:

a frame, forming means including a pair of coaxial forming rams, pressure chambers on said frame receiving said rams for extension and retraction of the rams along their common axis toward one another through working strokes to extended positions by fluid pressure in said chambers and away from one another through return strokes to cocked positions, ram retractor means on said frame for retracting said rams to cocked position, and ram locking means on said frame including a pair of ram locking members, means supporting said members for movement to ram latching positions wherein said locking members are disposed for latching engagement with said rams, respectively, when the rams are in their cocked positions for locking said rams in said cocked positions and for movement of said locking members to ram releasing positions wherein said locking members are disposed for complete disengagement from said rams to release said rams for free independent movement through their working strokes without movement of said locking members with said rams, and common ram lock actuator means connected to said locking members for moving said locking members in unison from their ram latching positions to their ram releasing positions to effect simultaneous release of said rams for movement through their working strokes by said chamber fluid pressure.

2. A high energy rate forming machine according to claim 1 including:

bolster means on said frame between said rams for holding work to be formed.

3. A high energy rate forming machine according to claim 2 wherein:

said bolster means includes work clamping means.

4. A high energy rate forming machine according to claim 2 including:

coacting work forming die parts on said rams and bolster means.

5. A high energy rate forming machine according to claim 1 wherein:

said locking member supporting means supports each locking member for movement along said frame parallel to said ram axis and for movement into and from latching engagement with the corresponding ram when the latter is in cocked position, and said retractor means comprises retractor actuator means for moving said locking members along said frame with said members in latching engagement with their rams and in directions to retract said rams to cocked position.

6. A high energy rate forming machine according to claim 5 wherein:

each locking member is rotatable into and from latching engagement with its ram about an axis parallel to said ram axis and is movable along its rotation axis by said retractor actuator means to retract its ram to cocked position.

7. A high energy rate forming machine according to claim 6 wherein:

said retractor actuator means comprises a fluid pressure actuator including a pair of telescoping members parallel to said axes and connected to said locking members, respectively, for rotation of said locking members in unison about their rotation axes into and from latching engagement with said rams by rotation of said telescoping members about their longitudinal axes and movement of said locking members along their rotation axes to retract said rams to cocked position by extension movement of said telescoping members, and said telescoping members opening a pressure chamber adapted to be pressurized for effecting extension movement of the latter members, and said ram lock actuator means comprises means for rotating said telescoping members about their longitudinal axis.

8. A high energy rate forming machine according to claim 7 including:

bolster means on said frame between said rams for holding work to be formed.

9. A high energy rate forming machine according to claim 8 including:

coacting work forming die parts on said rams and bolster means.

10. A high energy rate forming machine according to claim 1 including:

bolster means on said frame between said rams including means for holding an elongate work part to be formed with the ends of the part exposed at opposite sides of the bolster means for impact by said rams at the ends of their working strokes, and means for adjusting said bolster means to accommodate work parts of varying lengths, and means for adjusting said pressure chambers, their contained rams, and their respective ram locking members along said frame parallel to said ram axis to accommodate said range of work part lengths.

11. A high energy rate forming machine according to claim 10 wherein:

said locking members are rotatable to and from latching engagement with their respective rams about axes normal to said ram axis, and said ram lock actuating means comprises telescopic rotatable means on said frame parallel to said ram axis and geared to said locking members for rotation of the latter members in unison by rotation of said telescopic means on its longitudinal axis, and means for rotating said telescopic means.

12. A high energy rate forming machine according to claim 11 wherein:

said ram retractor means comprise fluid pressure actuated retractors mounted on said pressure chambers, respectively.

13. A high energy rate forming machine according to claim 1 wherein:

said ram retractor means comprise fluid pressure actuated retractors mounted on said pressure chambers, respectively.

14. A high energy rate forming machine according to claim 1 wherein:

said locking members are rotatable to and from latching engagement with their respective rams about axes normal to said ram axis.

15. In a high energy rate impact forming machine, the combination comprising:

a frame, forming means including a forming ram, and a pressure chamber on said frame receiving said ram for ram extension through a working stroke by fluid pressure in said chamber and ram retraction through a return stroke to a cocked position, and a ram retractor on said frame including aa member movable along and rotatable about an axis parallel to the path of ram movement, a shoulder on said member rotatable into and from said path by rotation of said member about said axis, means for driving said member along said axis, and means for rotating said member about said axis, whereby said retractor is operable to retract said ram to and latch said ram in cocked position and then release said ram for extension through a working stroke.

16. A high energy rate forming machine according to claim 15 wherein:

said retractor driving means comprises a second retractor member disposed in telescoping relation with said first retractor member and defining with the latter member a pressure chamber, means for pressurizing said retractor pressure chamber to effect relative extension of said members for ram retraction, and means for effecting relative telescoping movement of said members to reengage said retractor shoulder with said ram.

17. A high energy rate forming machine according to claim 15 wherein:

said retractor rotating means comprises a coaxial pinion about said retractor member, a rack plate parallel to said retractor axis and meshing with said pinion throughout the range of travel of said member along said retractor axis, and means for moving said rack plate edgewise.

18. A high energy rate forming machine according to claim 15 wherein:

said retractor driving means comprises a second retractor member disposed in telescoping relation with said first retractor member and defining with the latter member a pressure chamber, means for pressurizing said retractor pressure chamber to effect relative extension of said members for ram retraction, and means for effecting relative telescoping movement of said members to reengage said retractor shoulder with said ram, and said retractor rotating means comprises a coaxial pinion about said first retractor member, a rack plate parallel to said retractor axis and meshing with said pinion throughout the range of travel of said first member along said retractor axis, and means for moving said rack plate edgewise.

19. A high energy rate forming machine according to claim 18 including:

a bolster on said frame, and cooperating forming die means on said ram and bolster.

20. A high energy rate impact forming machine, comprising:

a frame, forming means including a pair of coaxial forming rams, and pressure chambers on said frame receiving said rams for extension of the rams toward one another through working strokes to extended positions by fluid pressure in said chambers and retraction of said rams away from one another through return strokes to cocked positions, and a ram retractor on said frame including members movable longitudinally relative to one another along a common axis parallel to the path of ram movement and rotatable in unison about said axis, shoulders on said members rotatable into and from said path by rotation of said members about said axis, means for driving said members longitudinally relative to one another along said axis, and means for rotating said members in unison about said axis, whereby said retractor is operable to retract said rams to and latch said rams in their cocked positions and then release said rams simultaneously for extension of the rams through their working strokes in unison.

21. A high energy rate forming machine according to claim 20 wherein:

said retractor members are disposed in telescoping relation and define a pressure chamber, and said retractor driving means comprises means for pressurizing said retractor pressure chamber to effect relative extension of said members for ram retraction, and means for effecting relative telescoping movement of said members to re-engage said retractor shoulders with said rams.

22. A high energy rate forming machine combination according to claim 20 wherein:

said retractor rotating means comprise coaxial pinions about said retractor members, rack plate means parallel to said retractor axis and meshing with said pinions throughout the range of travel of said members along said retractor axis, and means for moving said rack plate edgewise.

23. A high energy rate forming machine according to claim 20 wherein:

said retractor members are disposed in telescoping relation and define a pressure chamber, said retractor driving means comprises means for pressurizing said retractor pressure chamber to effect relative extension of said members for ram retraction, and means for effecting relative telescoping movement of said members to re-engage said retractor shoulders with said rams, and said retractor rotating means comprise coaxial pinions about said retractor members, rack plate means parallel to said retractor axis and meshing with said pinions throughout the range of travel of said members along said retractor axis, and means for moving said rack plate edgewise.

24. A high energy rate forming machine according to claim 23 including:

a bolster on said frame between said rams, and cooperating forming die means on said rams and bolster.

25. In a high energy rate impact forming machine, the combination comprising:

a frame, forming means including a forming ram, and a pressure chamber on said frame receiving said ram for ram extension through a working stroke by fluid pressure in said chamber and ram retraction through a return stroke to a cocked position, retractor means for retracting said ram to cocked position, ram locking means for latching said ram in cocked position including a ram locking member rotatable on an axis normal to the ram axis into and from latching engagement with said ram when in cocked position, and means for rotating said locking member, and means for adjusting said forming means, retractor means, and locking means in unison along said frame parallel to the ram axis.

26. In a high energy rate impact forming machine, the combination comprising:

a frame, forming means including a forming ram, and a pressure chamber on said frame receiving said ram for ram extension through a working stroke by fluid pressure in said chamber and ram retraction through a return stroke to a cocked position, retractor means for retracting said ram to cocked position, said retractor in position, said retractor means comprising a fluid pressure actuated retractor on said pressure chamber including a cylinder, a retractor piston movable in said cylinder, and a lost motion connection between said piston and ram, whereby said piston is movable in one direction to retract said ram and in the opposite direction to release said ram for extension through its working stroke, and ram locking means independent of said retractor means for latching said ram in cocked position, whereby said ram may be retracted to said cocked position by said retractor piston and latched in the cocked position after which said retractor piston may be moved to release said ram for movement through its working stroke while the ram remains latched in cocked position.

27. A high energy rate impact forming machine, comprising:

a frame, forming means including a pair of coaxial forming rams, and pressure chambers on said frame receiving said rams for extension of the rams toward one another through working strokes to extended positions by fluid pressure in said chambers and retraction of said rams away from one another through return strokes to cocked positions, retractor means for retracting said rams to cocked position, and ram locking means for latching said rams in cocked position including a pair of locking members rotatable about axes normal to the ram axis to ram latching positions wherein said locking members are disposed for latching engagement with said rams when in cocked position and to ram releasing positions wherein said locking members are disposed for complete disengagement from said rams to release said rams for movement through their working strokes without movement of said locking members with said rams, and common actuator means connected to said locking members for rotating said locking members in unison from their ram latching positions to their ram releasing positions to effect simultaneous release of said rams for movement through their working strokes by said chamber fluid pressure.

28. A high energy rate forming machine according to claim 27 including:

bolster means on said frame between said rams including means for holding an elongate work part to be formed with the ends of the part exposed at opposite sides of the bolster means for impact by said rams at the ends of their working strokes, and means for adjusting said bolster means to accommodate work parts of varying lengths, and means for adjusting said pressure chambers, their contained rams, and their respective ram locking members along said frame parallel to said ram axis to accommodate said range of work part lengths.

29. A high energy rate forming machine according to claim 28 wherein:

said means for rotating said locking members in unison comprises telescopic rotatable means on said frame parallel to said ram axis and geared to said locking members for rotation of the latter members in unison by rotation of said telescopic means on its longitudinal axis, and means for rotating said telescopic means.

30. A high energy rate forming machine according to claim 29 wherein:

said retractor means comprises ram retractors on said pressure chambers, respectively.

31. A high energy rate impact forming machine, comprising:

a frame, forming means including a pair of coaxial forming rams, stationary bolster means on said frame between said rams for holding work to be formed with the work confronting each of the rams, coacting work forming die parts on said rams and bolster means, pressure chambers on said frame receiving said rams for extension and retraction of the rams along their common axis toward one another through working strokes to extended positions by fluid pressure in said chambers and away from one another through return strokes to cocked positions, ram retractor means on said frame for retracting said rams to cocked position, ram locking means movable into engagement with said rams for latching said rams in cocked position and movable from disengagement with said rams to release the rams for free independent movement through their working strokes without movement of said locking means with the rams, and common means connected to said ram locking means for actuating the ram locking means in unison such that the rams are released simultaneously.

32. A high energy rate impact forming machine according to claim 31, wherein:

the work is a single workpiece and respective portions thereof to be formed confront respective ones of said rams.

33. A high energy rate impact forming machine according to claim 31, wherein:

the work comprises separate respective workpieces confronting respective ones of said rams.

* * * * *